US011056274B2

(12) United States Patent
Jung et al.

(10) Patent No.: US 11,056,274 B2
(45) Date of Patent: Jul. 6, 2021

(54) THIN FILM TYPE INDUCTOR

(71) Applicant: SAMSUNG ELECTRO-MECHANICS CO., LTD., Suwon-Si (KR)

(72) Inventors: Jung Hyuk Jung, Suwon-Si (KR); Ki Young Yoo, Suwon-Si (KR); Hye Yeon Cha, Suwon-Si (KR); Ji Hye Oh, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 268 days.

(21) Appl. No.: 16/050,808

(22) Filed: Jul. 31, 2018

(65) Prior Publication Data

US 2019/0103215 A1 Apr. 4, 2019

(30) Foreign Application Priority Data

Sep. 29, 2017 (KR) ..... 10-2017-0127951

(51) Int. Cl.
*H01F 27/29* (2006.01)
*H01F 5/00* (2006.01)
(Continued)

(52) U.S. Cl.
CPC ..... *H01F 27/29* (2013.01); *H01F 5/003* (2013.01); *H01F 5/04* (2013.01); *H01F 17/0006* (2013.01);
(Continued)

(58) Field of Classification Search
CPC ..... H01F 27/29; H01F 5/003
See application file for complete search history.

(56) References Cited

U.S. PATENT DOCUMENTS 4,392,013 A * 7/1983 Ohmura ..... H01L 21/705 174/253
6,600,404 B1 * 7/2003 Kajino ..... H01F 5/003 257/531
(Continued)

FOREIGN PATENT DOCUMENTS

JP 2006-310716 A 11/2006
JP 2006310716 A * 11/2006
(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A thin film type inductor includes a body and external electrodes disposed on an external surface of the body. The body includes a support member and an internal coil supported by the support member, the internal coil includes an upper coil disposed on one surface of the support member and a lower coil disposed on the other surface thereof, and the upper and lower coils are connected to each other by a via electrode. Heights of a plurality of coil patterns arranged along a first virtual line are substantially equal to each other, and heights of a plurality of coil patterns arranged along a second virtual line increase toward the external surface of the body, where the first virtual line radiates from a center of a core of the body toward the via electrode and the second virtual line radiates in the opposite direction.

19 Claims, 4 Drawing Sheets

(51) Int. Cl.

| | |
|---|---|
| ***H01F 17/00*** | (2006.01) |
| ***H01F 5/04*** | (2006.01) |
| ***H01F 27/02*** | (2006.01) |
| *H01F 17/04* | (2006.01) |

(52) U.S. Cl.
CPC ..... *H01F 17/0013* (2013.01); *H01F 27/022* (2013.01); *H01F 27/292* (2013.01); *H01F 2017/048* (2013.01)

(56) References Cited

U.S. PATENT DOCUMENTS

2004/0164835 A1* 8/2004 Shoji ..... H01F 17/0013 336/200
2008/0174397 A1* 7/2008 de Rooij ..... G01R 33/3621 336/200
2009/0003191 A1* 1/2009 Inuzuka ..... H01F 17/0013 369/283
2009/0322458 A1* 12/2009 Lee ..... H01F 17/0006 335/299
2012/0126926 A1* 5/2012 Kroener ..... H01F 41/04 336/199
2013/0222101 A1* 8/2013 Ito ..... H01F 5/003 336/83
2013/0300527 A1* 11/2013 Kim ..... H01F 41/04 336/83
2014/0009254 A1* 1/2014 Ohkubo ..... H01F 27/29 336/192
2015/0035640 A1* 2/2015 Wang ..... H01F 27/2804 336/200
2015/0340149 A1* 11/2015 Lee ..... H05K 1/165 174/260
2016/0163444 A1* 6/2016 Choi ..... H01F 17/04 336/200
2016/0276094 A1* 9/2016 Lee ..... H01F 27/324

FOREIGN PATENT DOCUMENTS

KR 10-1999-0066108 A 8/1999
KR 10-2016-0111153 A 9/2016

* cited by examiner

THIN FILM TYPE INDUCTOR

CROSS-REFERENCE TO RELATED APPLICATION(S)

This application claims the benefit of priority to Korean Patent Application No. 10-2017-0127951, filed on Sep. 29, 2017 in the Korean Intellectual Property Office, the disclosure of which is incorporated herein by reference in its entirety.

BACKGROUND

1. Field

The present disclosure relates to a thin film type inductor.

2. Description of Related Art

In accordance with the development of information technology (IT), apparatuses have been rapidly miniaturized and thinned. Therefore, market demand for small, thin devices has increased.

Korean Patent Laid-Open Publication No. 10-1999-0066108 provides a power inductor including a substrate having a via hole and coils disposed on opposite surfaces of the substrate and electrically connected to each other by the via hole of the substrate, in accordance with such a technical trend to provide an inductor including coils having uniform and high aspect ratios. However, there remains a limitation in forming the coils having uniform and high aspect ratios, due to limitations in the manufacturing process. Further, in an inductor, magnetic flux is concentrated in the central core region, and technical improvements of a structure of the region where the magnetic flux is concentrated, as described above, have been required.

SUMMARY

An aspect of the present disclosure may provide a thin film type inductor in which Rdc characteristics and Ls characteristics are simultaneously improved.

According to an aspect of the present disclosure, a thin film type inductor includes: a body including a support member including a through hole and a via hole spaced apart from the through hole and filled with a conductive material, an internal coil supported by the support member, and a magnetic material encapsulating the support member and the internal coil and filling the through hole; and first and second external electrodes disposed on an external surface of the body and connected to both end portions of the internal coil, respectively.

The internal coil includes a first coil disposed on an upper surface of the support member and a second coil disposed on a lower surface of the support member, the first and second coils are connected to each other by a via electrode formed by filling the via hole with the conductive material, and each of the first and second coils includes a plurality of coil patterns.

Heights of a plurality of coil patterns arranged along a first virtual line are substantially equal to each other, and heights of a plurality of coil patterns arranged along a second virtual line increase toward the external surface of the body, where the first virtual line radiates from a center of a core of the body toward the via electrode and the second virtual line radiates in the opposite direction.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Figure 1:
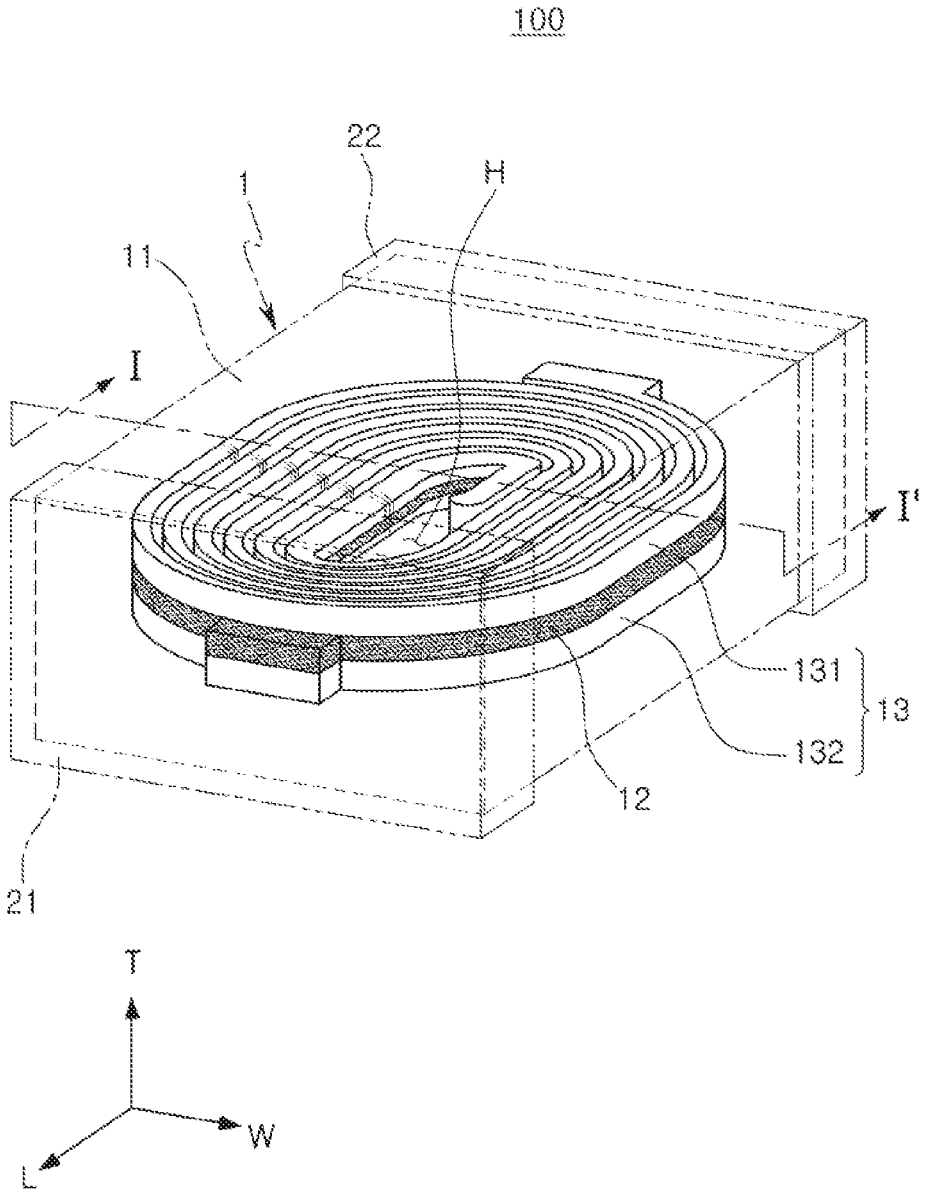
FIG. 1 is a schematic perspective view of a thin film type inductor according to an exemplary embodiment in the present disclosure.
Figure 2:
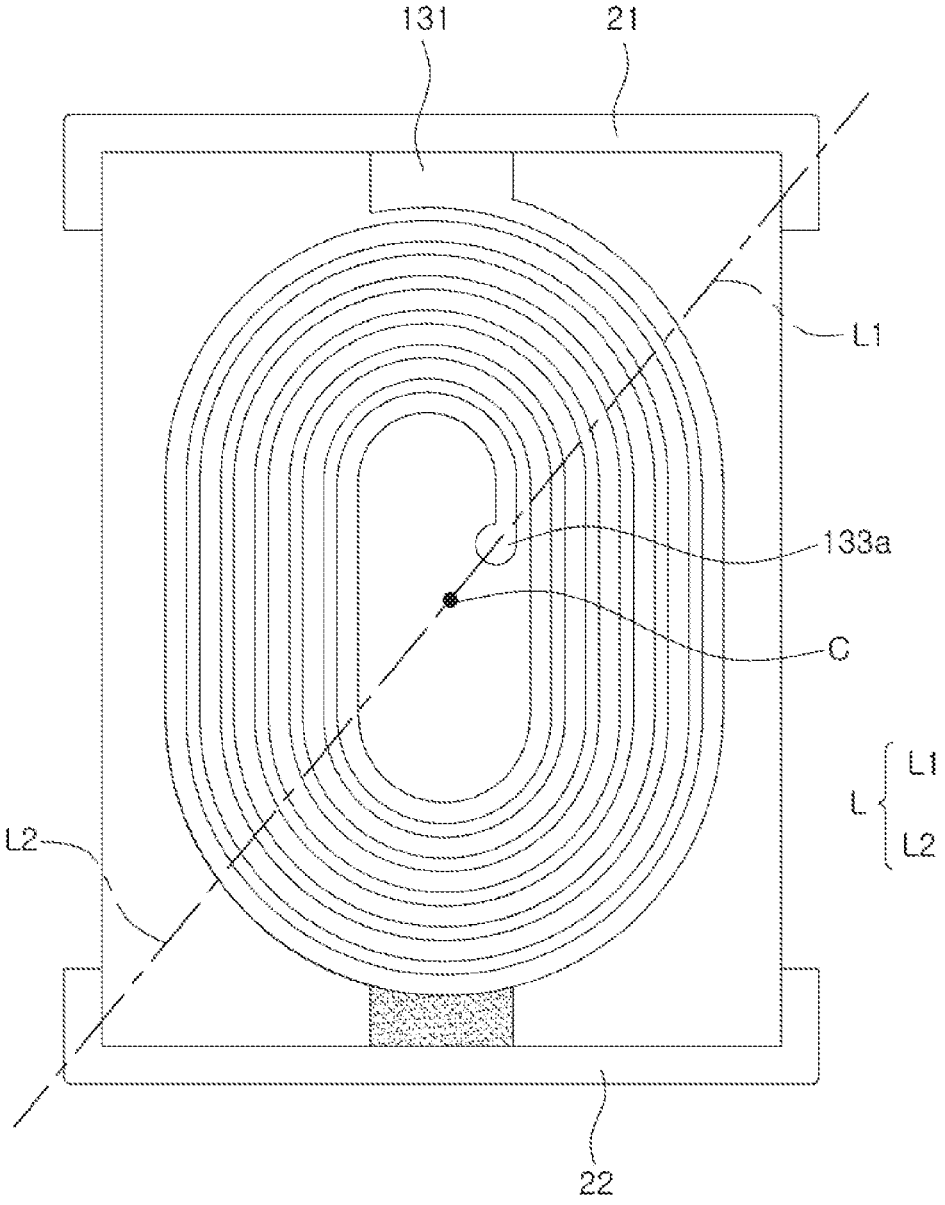
FIG. 2 is a top view of the thin film type inductor of FIG. 1 to which a virtual line is added.
Figure 3:
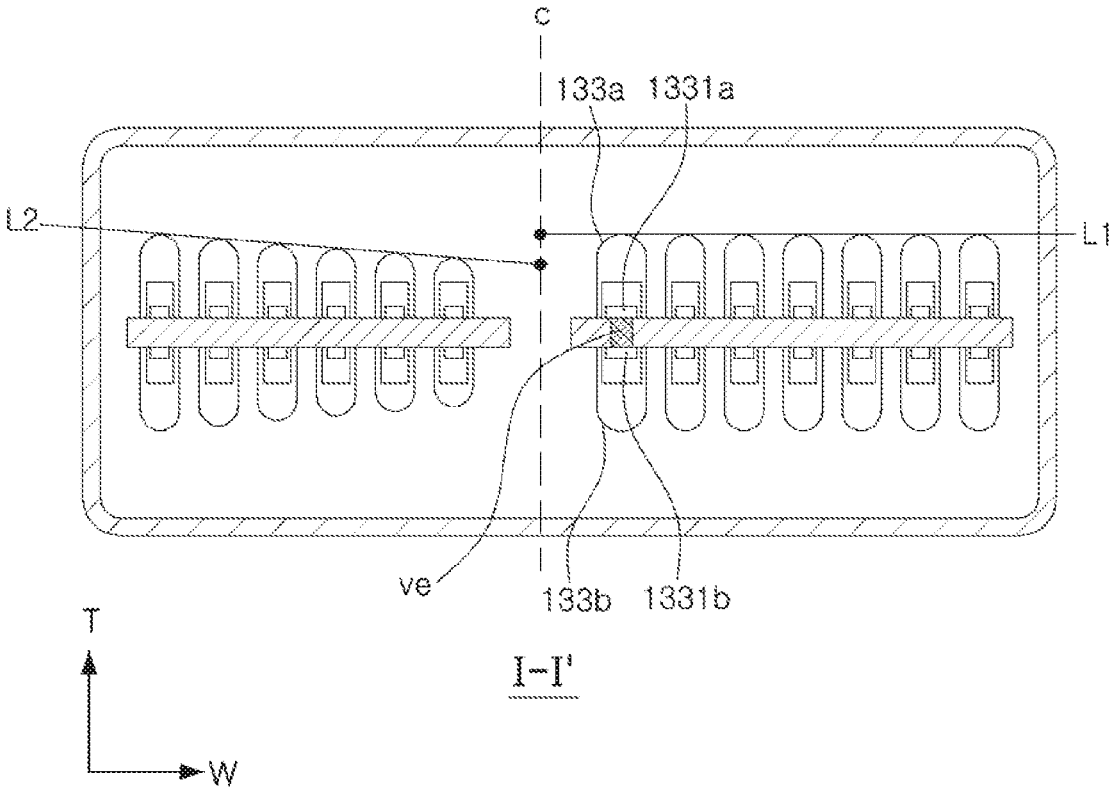
FIG. 3 is a cross-sectional view taken along line I-I' of FIG. 1.

FIG. 1 is a schematic perspective view of a thin film type inductor according to an exemplary embodiment in the present disclosure, and FIG. 2 is a top view of the thin film type inductor of FIG. 1. Further, FIG. 3 is a cross-sectional view taken along line I-I' of FIG. 1. In FIGS. 2 and 3, for convenience of explanation, virtual lines L1 and L2 are added.

Referring to FIGS. 1 through 3, a thin film type inductor 100 according to the exemplary embodiment in the present disclosure may include a body 1 and first and second external electrodes 21 and 22 disposed on an external surface of the body.

Although the first and second external electrodes having an alphabet "C" shape are illustrated, a specific shape of the first and second external electrode is not particularly limited as long as the first and second external electrodes may be electrically connected to an internal coil of the body. The first and second external electrodes may be formed of a conductive material.

The body 1, which forms an entire exterior of the thin film type inductor, may have upper and lower surfaces opposing each other in a thickness (T) direction, first and second end surfaces opposing each other in a length (L) direction, and first and second side surfaces opposing each other in a width (W) direction to thereby have a substantially hexahedral shape. However, an external shape of the body is not limited thereto.

The body 1 may contain a magnetic material 11. For example, the body 1 may be formed by filling a ferrite material or a metal based soft magnetic material. An example of the ferrite may include ferrite known in the art such as Mn—Zn based ferrite, Ni—Zn based ferrite, Ni—Zn—Cu based ferrite, Mn—Mg based ferrite, Ba based ferrite, Li based ferrite, or the like. The metal based soft magnetic material may be an alloy containing at least one selected from the group consisting of Fe, Si, Cr, Al, and Ni. For example, the metal based soft magnetic material may contain Fe—Si—B—Cr based amorphous metal particles, but is not limited thereto. The metal based soft magnetic material may have a particle diameter of 0.1 μm or more to 20 μm or less and be contained in a form in which the metal based soft magnetic material is dispersed on a polymer such as an epoxy resin, polyimide, or the like.

Meanwhile, a support member 12 and an internal coil 13 may be encapsulated by the magnetic material 11 of the body 1. The support member 12 may serve to support the internal coil 13 and allow the internal coil 13 to be more easily formed. As the support member 12, a support member having insulation properties and having a thin plate shape may be suitably used. For example, a copper clad laminate (CCL) substrate, an ajinomoto build-up film (ABF) insulating film, or the like, may be used. A specific thickness of the support member 12 may be thin in order to satisfy the trend toward miniaturization of an electronic component, but the board needs to have a thickness enough to suitably support the internal coil 13. Therefore, for example, the board may have a thickness of about 60 μm. Further, a central hole H may be formed in the center of the support member 12, and the central hole may be filed with the magnetic material. Entire permeability may be improved by filling the central hole with the magnetic material. Further, a via hole v may penetrate through the support member at a position spaced apart from the central hole by a predetermined interval. A conductive material may be filled in the via hole v, thereby forming a via electrode ve electrically connecting first and second coils 131 and 132 disposed on upper and lower surfaces of the support member 12, respectively.

Each of the first and second coils 131 and 132 may include a plurality of coil patterns. Among the plurality of coil patterns, connection coil patterns 133*a* and 133*b* may be directly connected to the via electrode ve, and the connection coil pattern 133*a* corresponding to a portion of the first coil 131 and the connection coil pattern 133*b* corresponding to a portion of the second coil 132 may be electrically and physically connected to each other by the via electrode ve.

Further, each of the plurality of coil patterns may include at least two coil layers, and at least one of the coil layers may be formed of an anisotropic plating layer. Here, the anisotropic plating layer may mean a plating layer of which a growth rate in a specific direction, particularly, in a T direction, is larger than that in other directions in view of a growth rate of a coil and thus a thickness of the coil is further increased as compared to a width of the coil.

In this case, the connection coil patterns 133*a* and 133*b* may include a plurality of coil layers similarly to the other coil patterns. The connection coil patterns 133*a* and 133*b* may be formed integrally with the via electrode ve. Here, the connection coil patterns 133*a* and 133*b* are formed integrally with the via electrode ve, which means that there is no boundary line between the connection coil patterns and the via electrode. When the connection coil patterns 133*a* and 133*b* are formed integrally with the via electrode ve, coil layers 1331*a* and 1331*b* disposed in lowermost portions of the connection coil patterns may be simultaneously formed with the via electrode ve to thereby be integrated with the via electrode ve.

Meanwhile, describing the coil pattern composed of a plurality of layers in more detail, the coil patterns are composed of the plurality of layers, which means that there are boundary lines between the layers. This may mean that these layers are formed through different processes from each other. For example, this may means that the coil layers disposed in the lowermost portions of the connection coil pattern and coil layers disposed in lowermost portions of other coil patterns, disposed on the same plane as each other are formed through the same process as each other. As described above, each of the plurality of coil patterns may include the plurality of layers, such that a high aspect ratio may be implemented, and process stability may be secured. When each of the plurality of coil patterns is implemented as a single layer, as the coil grows, it may become more difficult to control shapes or growth direction of the coil patterns, such that a risk of a short-circuit between adjacent coil patterns may be increased.

Meanwhile, a specific structure of the coil pattern will be described based on the first coil with reference to FIGS. 2 and 3. A detailed description of the first coil may be applied to the second coil as it is, and thus, a separate description of the second coil will be omitted.

There is a virtual line L connecting the connection coil pattern 133*a* among the plurality of coil patterns and the center C of a core of the coil to each other, wherein the virtual line L includes a first virtual line L1 toward the via electrode based on the center of the core and a second virtual line L2 opposite thereto.

When the plurality of coil patterns are disposed along the first virtual line, heights of the plurality of coil patterns may be maintained to be substantially equal to each other. When the plurality of coil patterns are disposed along the first virtual line, the heights of the plurality of coil patterns may be maintained to be equal to each other, which means that even though the coil is wound several times, a height of the coil may be maintained at a significantly high level, and means that a state in which an aspect ratio (AR) of the internal coil is significantly high may be maintained. As a result, the internal coil may be implemented so as to have relatively small Rdc.

Further, when the plurality of coil patterns are formed on the support member, a plating method may be mainly used. Due to characteristics of the plating method, a height of the coil pattern and a width of the coil pattern may be generally in proportion to each other. Here, the term "generally" means that a general plating method, for example, an isotropic plating method is performed without performing separate treatment. Therefore, the easiest method for restricting the height of the coil pattern to be small is to restrict the width of the coil in proportion to the height. However, when a coil pattern of which a width is decreased is the connection coil pattern directly connected to the via electrode and the via electrode, a possibility that a via open failure will occur may be increased. The via open failure means a case in which at the time forming the via electrode and the connection coil pattern, the connection coil pattern and the via electrode are not aligned corresponding to the via hole formed in the support member, and thus the first and second coils are not electrically connected to each other. Therefore, it is not advantageous to decrease the width of the connection coil pattern in views of structural stability and connection stability of the internal coil as well as Rdc. Accordingly, there is a need to sufficiently secure the width of the connection coil pattern to prevent a problem in reliability such as the via open failure, or the like, in advance. As a result, the height of the connection coil pattern may be sufficiently secured. The height and the width of the connection coil pattern may be the same as those of an adjacent coil pattern arranged along the first virtual line L1, and selectively, in order to more clearly prevent the via open failure, the connection coil pattern may be controlled to have a width Wcc wider than that of the adjacent coil pattern Wac even though the connection coil pattern has the same height as that of the adjacent coil pattern.

Next, when the plurality of coil patterns are arranged along the second virtual line L2, heights of the coil patterns tend to be increased toward the external surface of the body. Among the coil patterns, a coil pattern disposed in an outermost portion may have the highest height. The heights of the coil patterns tend to be increased toward the external surface of the body, which is to form a coil pattern adjacent to a magnetic core to have a relatively low height to optimize a flow of a magnetic flux while sufficiently decreasing Rdc of the coil. When the coil pattern adjacent to the magnetic core is formed to have a relatively low height, the flow of the magnetic flux may be optimized. The reason is that since the magnetic flux is concentrated on the magnetic core, particularly, in the vicinity of an innermost edge of the internal coil, when the coil pattern in the vicinity of the magnetic core has a relatively low height, the flow of the concentrated magnetic flux may become smooth. Of course, when an entire thickness of an innermost coil pattern is relatively low, the flow of the magnetic flux may become more smooth in the vicinity of the magnetic core, but according to the present disclosure, a possibility that a problem such as the via open failure will occur may be prevented in advance by maintaining the height of the connection coil pattern directly connected to the via electrode among the innermost coil patterns at a sufficiently high level to create an environment in which the connection coil pattern may have a sufficient width. Further, entire Rdc of the internal coil may be maintained to be sufficiently low by significantly decreasing only a height of a coil pattern facing the connection coil pattern based on the center of the core among the innermost coil patterns and allowing the heights of the coil patterns to be gradually increased in a winding direction.

Meanwhile, in a case of increasing the heights of the plurality of coil patterns arranged along the second virtual line L2, as long as an increase tendency is maintained, there is no need to maintain a degree of increase at a constant value. Here, the increase tendency is maintained, which means that among the plurality of coil patterns arranged along the second virtual line, a height of a coil pattern close to the external surface of the body is equal to or higher than a coil pattern directly adjacent thereto. Further, the height may be defined as a distance from a highest point in the upper surface of each of the coil pattern to a lower surface of each of the coil pattern.

Referring to FIG. 3, although a case in which a rate of increase in heights T of adjacent coil patterns is maintained to be substantially equal is illustrated, the rate of increase is not limited thereto. That is, the rate of increase may also be decreased or increased (not illustrated). In this case, the rate of increase in heights of the coil patterns arranged along the second virtual line may be decreased toward the outermost coil pattern. The rate of increase may be decreased when the height of the coil patterns is at a substantially similar level to the height of the outermost coil pattern, and the increased height is substantially maintained. Here, since the number of coil patterns having a relatively high aspect ratio is increased, an entire Rdc value may be secured.

In addition, a height of a coil pattern which is disposed in an outermost portion and is closest to the external surface of the body among the plurality of coil patterns arranged along the second virtual line L2 may be substantially equal to the height of the coil patterns arranged along the first virtual line L1. In this case, since the outermost coil pattern is wound while maintaining the highest height, this case is advantageous for decreasing Rdc.

Figure 4:
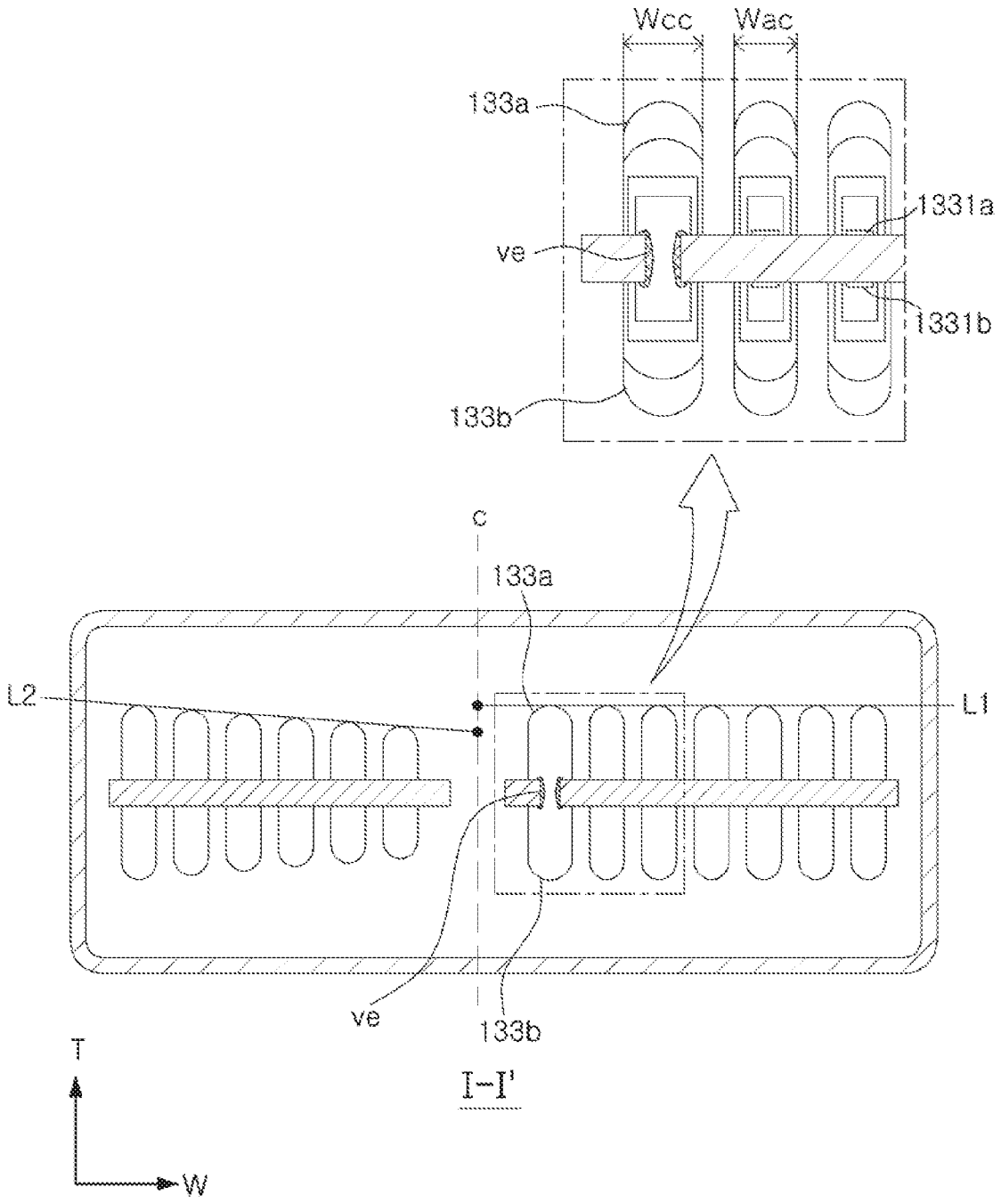
FIG. 4 is a cross-sectional view of a thin film type inductor according to another exemplary embodiment in the present disclosure.

Next, FIG. 4 illustrates a thin film type inductor according to another exemplary embodiment. Here, only a connection structure between a via electrode and a connection coil pattern is different, but other components are substantially equal to those described above. Therefore, for convenience of explanation, only a difference between the inductors of FIGS. 1-3 and 4 will be described, an overlapping description will be omitted, and the same components will be denoted by the same reference numerals.

Referring to FIG. 4, the via electrode may be formed to enclose both side surfaces of a via hole. This may be sufficiently controlled by forming a seed layer for forming the via electrode in a shape corresponding to the via electrode. In this case, in relation to a lowermost layer of the connection coil pattern disposed on the via electrode, a distance between a lowermost layer of a connection coil pattern of a first coil and a lowermost layer of a connection coil pattern of a second coil may be closer to each other. Further, when the via electrode is formed to be thin, the connection coil patterns of the first and second coils may be physically connected to each other. In this case, a defect that the connection coil pattern is physically separated from the via electrode may be prevented in advance. When the connection coil pattern of each of the first and second coils is directly connected to only the via electrode, in a case in which the connection coil pattern and the via electrodes are formed of different materials, a defect that the connection coil pattern may be detached from the via electrode may occur. However, in FIG. 4, the above-mentioned defect may be decreased.

With the above-mentioned thin film type inductor, the flow of the magnetic flux may be optimized by decreasing a thickness of at least a portion of the coil pattern in the vicinity of the core region on which the magnetic flux is relatively concentrated.

However, in this case, the thickness of the connection coil pattern directly connected to the via electrode may be secured at a level corresponding to a thickness of the thickest coil pattern, for example, the thickness of the outermost coil pattern in order to prevent an open failure of the via electrode directly connected to the innermost coil pattern, such that reliability of the thin film type inductor may be secured.

Further, the height of the coil pattern may be sufficiently secured so that the entire Rdc value is secured in an effective range by gradually decreasing a difference in thickness between coil patterns facing each other at the time of continuously winding the coil patterns from the innermost coil pattern to the outermost coil pattern in a spiral shape while significantly decreasing the thickness of the coil pattern facing the connection coil pattern among the innermost coil patterns.

As set forth above, according to exemplary embodiments in the present disclosure, an Isat value may be improved by allowing the magnetic flux in the vicinity of the center of the core of the coil to smoothly flow, and Rdc may be decreased by differentiating a structure of each of the coil patterns.

While exemplary embodiments have been shown and described above, it will be apparent to those skilled in the art that modifications and variations could be made without departing from the scope of the present invention as defined by the appended claims.

What is claimed is:

1. A thin film type inductor comprising:

a body including a support member including a through hole and a via hole spaced apart from the through hole and filled with a conductive material, an internal coil supported by the support member, and a magnetic material encapsulating the support member and the internal coil and filling the through hole; and first and second external electrodes disposed on an external surface of the body and connected to both end portions of the internal coil, respectively, wherein the internal coil includes a first coil disposed on an upper surface of the support member and a second coil disposed on a lower surface of the support member, the first and second coils being connected to each other by a via electrode formed by filling the via hole with the conductive material, each of the first and second coils includes a plurality of coil patterns, heights of a plurality of coil patterns arranged along a first virtual line are substantially equal to each other, and heights of a plurality of coil patterns arranged along a second virtual line increase toward the external surface of the body, where the first virtual line radiates from a center of a core of the body toward the via electrode and the second virtual line radiates in the opposite direction, a connection coil pattern, among the plurality of coil patterns arranged along the first virtual line, is directly connected to the via electrode, and wherein heights of at least three of the plurality of coil patterns arranged along the second virtual line increase toward the external surface of the body.

2. The thin film type inductor of claim 1, wherein the connection coil pattern has a width wider than that of another coil pattern adjacent thereto.

3. The thin film type inductor of claim 1, wherein among the plurality of coil patterns arranged along the first virtual line, an outermost coil pattern has the same height as that of an outermost coil pattern among the plurality of coil patterns arranged along the second virtual line.

4. The thin film type inductor of claim 1, wherein a boundary line between the via electrode and the connection coil pattern is disposed on the same plane as at least one surface of the support member.

5. The thin film type inductor of claim 4, wherein the connection coil pattern includes a plurality of coil layers, and among the plurality of coil layers, a coil layer disposed in a lowermost portion comes into contact with the via electrode.

6. The thin film type inductor of claim 5, wherein at least one of the plurality of coil layers has a greater extent in a thickness direction than in a width or length direction.

7. The thin film type inductor of claim 1, wherein the via electrode has a shape enclosing both side surfaces of the via hole.

8. The thin film type inductor of claim 7, wherein the connection coil pattern includes a connection coil pattern of the first coil and a connection coil pattern of the second coil, and the connection coil patterns of the first and second coils are physically connected to each other.

9. The thin film type inductor of claim 1, wherein a rate of increase in height of the plurality of coil patterns disposed along the second virtual line toward the external surface of the body is constant between adjacent coil patterns.

10. The thin film type inductor of claim 1, wherein the internal coil has a spiral shape.

11. The thin film type inductor of claim 1, wherein each of the plurality of coil patterns includes a plurality of coil layers.

12. The thin film type inductor of claim 11, wherein at least one of the plurality of coil layers has a greater extent in a thickness direction than in a width or length direction.

13. The thin film type inductor of claim 1, wherein a maximum width of an outermost coil pattern among the plurality of coil patterns arranged along the second virtual line is wider than that of a coil pattern most adjacent thereto.

14. The thin film type inductor of claim 1, wherein a rate of increase in height of the plurality of coil patterns disposed along the second virtual line decreases toward an outermost coil pattern.

15. The thin film type inductor of claim 1, further comprising an insulating layer on a surface of the internal coil.

16. The thin film type inductor of claim 15, wherein a shortest distance from an uppermost surface of an insulating layer on an innermost coil pattern among the plurality of coil patterns arranged along the second virtual line to an upper surface of the body is greater than a shortest distance from an uppermost surface of an insulating layer on the connection coil pattern among the plurality of coil patterns arranged along the first virtual line to the upper surface of the body.

17. The thin film type inductor of claim 1, wherein the plurality of coil patterns have an asymmetrical shape with respect to the center of the core of the body.

18. The thin film type inductor of claim 1, wherein another coil pattern of the plurality of coil patterns arranged along the first virtual line is directly connected to the via electrode.

19. The thin film type inductor of claim 1, wherein the through hole is devoid of the internal coil.

* * * * *